United States Patent [19]

Klemm

[11] 4,039,397

[45] Aug. 2, 1977

[54] PROCESS FOR PRODUCING SCREEN MATERIAL

[75] Inventor: Martin Klemm, Wiler near Utzenstorf, Switzerland

[73] Assignee: Fritz Buser AG Maschinenfabrik, Switzerland

[21] Appl. No.: 681,284

[22] Filed: Apr. 28, 1976

[30] Foreign Application Priority Data

May 2, 1975 Switzerland ..... 5645/75

[51] Int. Cl.[2] ..... C25D 1/08; C25D 5/02

[52] U.S. Cl. ..... 204/11; 204/24

[58] Field of Search ..... 204/11, 24, 281

[56] References Cited

U.S. PATENT DOCUMENTS

| | | | |
|---|---|---|---|
| 2,226,383 | 12/1940 | Norris | 204/11 |
| 2,246,380 | 6/1941 | Norris | 204/11 |
| 2,598,318 | 5/1952 | Teal | 204/24 |
| 3,586,609 | 6/1971 | Jansen | 204/11 |

*Primary Examiner*—T. M. Tufariello

*Attorney, Agent, or Firm*—Weingarten, Maxham & Schurgin

[57] ABSTRACT

A process for producing screen material by electrodeposition of metallic material on a matrix. The matrix has a smooth surface having conductive and non-conductive surface areas and material such as nickel is electrodeposited on the conductive areas in successive steps. Insulating material is applied between electrodeposition steps to confine the nickel to the desired size. Also disclosed is a similar method for making screen printing blocks by electroplating on a conductive surface wherein the areas not to be plated are coated with a photoresist.

8 Claims, 5 Drawing Figures

PROCESS FOR PRODUCING SCREEN MATERIAL

FIELD OF THE INVENTION

The invention generally relates to a process for producing screen material by the electrodeposition of a metallic deposit, and more particularly concerns a nickel deposit on the conductive portions of a smooth matrix provided with conductive and nonconductive surface portions.

DISCUSSION OF THE PRIOR ART

When producing screen material by electroplating and more particularly perforated nickel sleeves such as are used for producing hollow cylindrical screen printing blocks for rotary screen printing processes, it is known to use matrixes with a smooth surface on which conductive and non-conductive surface portions are arranged in such a way that a completely perforated screen material is obtained when nickel is electrodeposited. The smooth surface is in particular necessary when producing the above-mentioned perforated nickel sleeves, because otherwise at the end of the deposition process, the sleeve could not be removed from the matrix.

If the matrixes are produced by a stamping process, that is by milling, the conductive surface portions must have a minimum size for production reasons, whereby the width amounts to about 50 microns.

During electrodeposition the metal is built up not only in the vertical direction but also in the horizontal direction beyond the width of the conductive portion. As a result of this so-called overgrowing the flange width of the screen material is substantially larger than the width of the conductive portion at the surface of the matrix, so that with reference to the smallest distance between two conductive portions, it is necessary that a certain minimum distance be maintained. Since for strength reasons the screen material thickness must be at least 80–85 microns and the overgrowing of the conductive portion is normally approximately the same as the screen material thickness, a minimum flange width of the screen material of about 225 microns is obtained. On establishing a minimum screen opening of about 90–100 microns, which is necessary to obtain an adequate passage of ink, a spacing of the openings of about 310–320 microns is obtained by the prior art process, corresponding to a mesh size of 80 mesh (per inch).

If for the same flange width and screen material thickness the screen opening was kept infinitely small, this would correspond to a mesh size of about 110 mesh.

In summarizing it can be stated that when producing screen material by electroplating it is only possible to produce a relatively coarse-meshed product due to the fact that it is impossible to drop below the minimum screen material thickness while maintaining a screen opening adequate for the passage of ink.

SUMMARY OF THE INVENTION

The object of the present invention is to develop a process of the type indicated hereinbefore, in such a way that screen material with much finer mesh sizes or with much larger openings can be produced, and at the same time preventing any noteworthy increase in the manufacturing costs.

According to the invention the terminal layer thickness of the screen material layer is obtained by partial layers produced in at least two deposition operations.

Prior to the start of successive deposition operations the sides of the partial screen flanges of the partial layer already formed by the previous deposition operation and which surround the free spaces of the partial layer corresponding to the screen openings are covered with an electrically insulating material. The previously deposited partial layer surface is then freed from insulating material.

BRIEF DESCRIPTION OF THE DRAWING

The objects, features and advantages of the present invention will be apparent from the following description when read in conjunction with the accompanying drawing in which.

DESCRIPTION OF THE PREFERRED EMBODIMENTS

Figure 1:
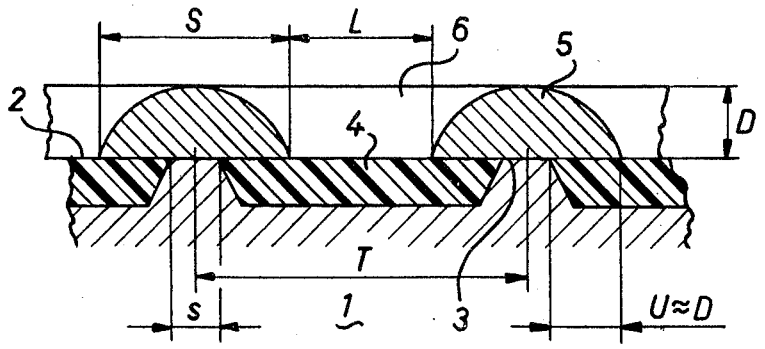
FIG. 1 is a partial section through a matrix serving for the production of screen material by electroplating with screen material deposited thereon, deposited up to terminal layer thickness in a single deposition operation.

In FIG. 1 a matrix 1 has a smooth surface 2 with conductive surface portions 3 and non-conductive surface portions 4. The non-conductive portions 4 of matrix 1 are produced in that free spaces 6 are formed between the conductive portions 3, whereon screen flanges 5 are formed during the electrodeposition of nickel. The free spaces are filled with insulating material. When producing perforated nickel sleeves, the matrix surface 2 is completely smooth, which can be obtained by means of grinding or other suitable operations.

The screen flanges 5 which are built up during deposition on the conductive portions 3 have a thickness D. There is simultaneously an overgrowth U having a width which is approximately the same as the thickness D of the screen material. Free space 6 corresponds to the screen opening between the screen flanges 5. It has an extremely small hole size L, which after removing the screen material from the matrix forms the screen opening.

If, on the surface 2 the conductive portion 3 of matrix 1 has a width s, then for a screen material thickness D the width S of deposited screen flange 5 is:

$$S = s + 2U$$

Thus the spacing T of the screen material is:

$$T = s + 2U + L = S + L.$$

As the quantities D, s and L are largely determined by practical requirements, it is not possible to obtain a mesh fineness of the screen material above about 80–100 mesh.

Figure 2:
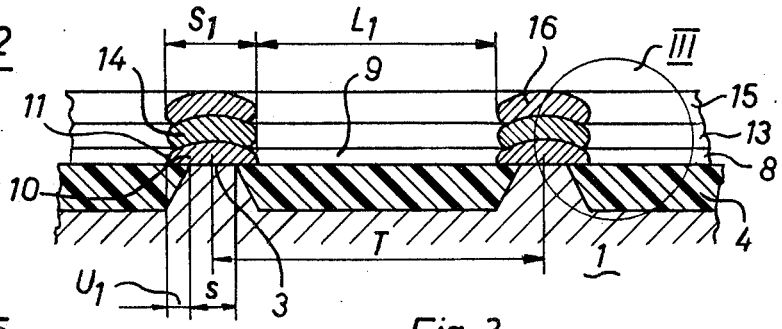
FIG. 2 is a partial section similar to FIG. 1 through the matrix with screen material deposited in three separate deposition operations, produced according to the process of the present invention.
Figure 4:
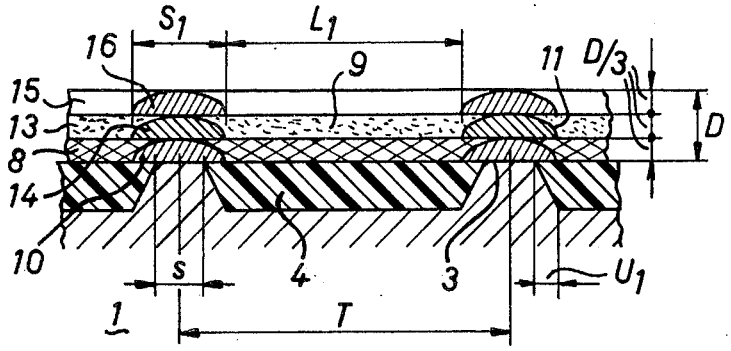
FIG. 4 is a partial section similar to FIG. 2, whereby the screen material is deposited according to a second embodiment of the process.

FIGS. 2 and 4 show the much smaller overgrowth of the flanges obtained with the same screen material thickness D when the screen is made according to the preferred embodiments of this invention. Here again the same matrix 1 with conductive portions 3 and non-conductive portions 4 as in FIG. 1 is used. The build-up of the screen material thickness D takes place in three separate deposition operations. Of course the invention is not limited to three deposition steps but that is a convenient and practical number. Initially a first partial layer 8 with a thickness of about a third of the final layer thickness D is deposited. Correspondingly, the overgrowth $U_1$ is only about a third of the final layer thickness D. The free spaces 9 of the partial layer located between the partial screen flanges 10 have a large hole size $L_1$:

$$L_1 = L + 1\tfrac{1}{3}\,U = L + 1\tfrac{1}{3}\,D.$$

Figure 3:
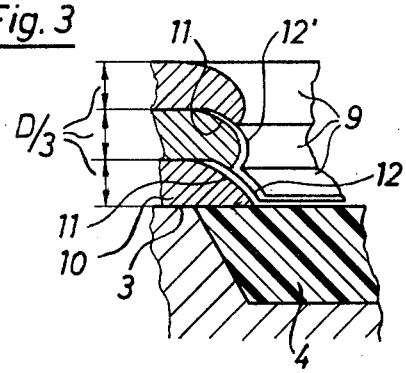
FIG. 3 is an enlarged cut-away portion III of FIG. 2.

Following the deposition of a partial layer of thickness D/3, the deposition process is interrupted and the sides of the partial screen flanges 10 are covered with an electrically insulating layer 12 as shown in FIG. 3. Although only sides 11 need to be covered, due to the fact that the layer 12 is likely applied by spraying, the non-conductive surface 4 of matrix 1 can also be covered, along with the top surface of the partial screen flanges. The top of the partial screen flanges 10 is then stripped of the insulating layer so that a conductive area whose width approximately corresponds to the flange width s of matrix 1 is formed on the partial screen flange 10. The insulating layer is only a few microns thick and can easily be removed by a simple process such as grinding.

After corresponding activation of the now exposed flanges 10, the deposition process is continued and a further partial nickel layer 13 with partial screen flanges 14 and a thickness of about D/3 is deposited. Partial layer 13 also leaves a free space of width $L_1$.

As in the case of the first partial layer, the sides 11 of the partial screen flanges 14 are covered with a thin layer 12' (FIG. 3) of an electrically insulated material which is placed over layer 12, and then the tops of the partial screen flanges 14 are then stripped or exposed in the same way. A third partial layer 15 with a thickness D/3 with partial flanges 16 is deposited thereon. Thus, the final layer thickness D is obtained, but with a much larger hole size $L_1$, than in the case of the screen material of FIG. 1.

It is essential that prior to the deposition of a further partial layer, with the exception of the final layer, the sides are covered with an insulating material, which may be an insulating varnish. These insulating layers 12, 12' can be very thin, normally only a few microns thick. As each partial screen flange grows over the width of the conductive flange, the sides 11 of partial layers 13, 15 become beak-shaped, that is they grow over the insulating layers 12, 12' in a somewhat downward direction, as shown in FIGS. 2 and 3, but this is in no way disadvantageous.

In FIG. 4, the sides 11 of the partial screen layers 8, 13 are electrically insulated in such a way that the free spaces 9 of the partial screen layers 8, 13 are filled by an insulating material following the termination of deposition and the surface is then smoothed, such as by grinding. In this way a conductive flange having the size of the original flange width *s,* is again formed on the particular partial flange $S_1$. The deposition process and the formation of the screen flange $S_1$ takes place in the same way as described relative to FIG. 2. There is, however, the small difference that the sides 11 cannot grow downwards, because the free space 9 is filled with insulating material and is flush with the top of the partial screen flanges 8, 13.

EXAMPLE

The matrix of FIG. 1 can have a spacing $T = 318$ microns and a conductive portion width $s = 54$ microns. Its screen flange width S becomes 222 microns in the case of a final layer thickness D of 84 microns of the screen material. Correspondingly the screen opening $L = 96$ microns.

If, however, the screen material is produced according to FIG. 2 the overgrowth $U_1 = 28$ microns, the screen flange width $S_1 = 110$ microns with the same $s = 54$ microns. As T is unchanged at 318 microns, the screen opening $L_1 = 208$ microns.

The ratio of the screen openings is correspondingly $L_1 : L = 2.17 : 1$, so that the area relationship of the screen openings is $F_1 : F = 4.8 : 1$.

With $L_1 = L = 96$ microns $T$ becomes $L + 2\,U_1 + s = 206$ microns, corresponding to a screen with a mesh size of about 125 mesh. Thus, the described process leads to a much finer meshed material without it being necessary to reduce the screen material thickness D. It is also unnecessary to change the conductive portion width *s,* although this may be possible when methods other than milling are used. Such alternative processes include photomechanical or electronic engraving for the purpose of producing matrix 1.

In place of the three partial layers 8, 13, 15 as shown in FIGS. 2–4, it is also possible to choose a different number of partial layers in order to influence the flange width S.

After removing the screen material from matrix 1, the insulating material located in the free spaces 9 is removed by a solvent.

By means of the described process, it is possible to obtain finer meshed screen material, without loss of screen opening cross-section for screen printing blocks for reproducing fine details, as well as normal-meshed screen material with an increased screen opening cross-section for screen printing blocks with a large passage for ink.

Figure 5:
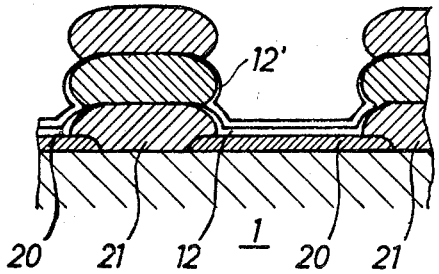
FIG. 5 is a partial section through a screen printing block produced by electroplating according to the invention.

The described process can also be used for producing screen printing blocks by an electroplating process shown in FIG. 5. The surface of a smooth matrix, or a matrix cylinder 1 with an electrically conductive surface is coated with a photoresist 20 and this layer is exposed by means of a diapositive, in which the printing areas are transparent with black line screen and the non-printing areas are black. After developing and fixing the black areas, the line screen of the diapositive give uncovered zones on matrix 1. The layer thickness of photoresist 20 is about 0.01 mm. A partial nickel layer 21 is now electrodeposited on the uncovered zones of matrix 1 and nickel deposition is interrupted when it projects beyond the layer thickness of photoresist 20, corresponding to the desired height of the partial nickel layer 21. The surface is then covered with an electrically insulating layer 12 as previously described. The top of the partial nickel layer 21 is then stripped such as by grinding, whereby a conductive portion is again formed on the partial nickel layer 21. The further build-up of the partial nickel layers takes place in accordance with FIG. 3. However, the build-up can also be in accordance with FIG. 4 as soon as the first partial nickel layer 21 has been electrodeposited on the matrix. In this way screen printing blocks can be produced by electroplating without there being any significant overgrowth of the edge portions of the non-printing areas.

The invention is not limited to the embodiments described and represented hereinbefore and various modifications can be made thereto by those skilled in the art which are within the scope of the invention.

What is claimed is:

1. A process for the production of screen material by means of electrodeposition of metal on a smooth surfaced matrix having conductive and non-conductive areas on said surface, said process comprising the steps of:

depositing a first partial layer of said metal on said conductive areas of said matrix to a depth substantially less than the desired screen material thickness; then coating the exposed surfaces, including the top and sides, of said first partial layer of said metal with an electrically insulating material;

stripping said insulating material from the top surface of said first partial layer; and then depositing a second partial layer of said metal on that portion of said first partial layer exposed by said stripping step.

2. The process according to claim 1 wherein the sides of said first partial layer of said metal are covered with a thin layer of electrically insulating varnish.

3. The process according to claim 1 wherein the sides of said first partial layer of said metal are covered by filling the free spaces between said deposited areas with an electrically insulating material.

4. A process for the production of screen material by means of electrodeposition of metal on a smooth surfaced matrix having conductive and non-conductive areas on said surface, said process comprising the steps of:

depositing said metal on said conductive areas of said matrix in at least two deposition operations to produce a terminal layer thickness built up of at least two partial layers of deposited metal;

coating the exposed top and side surfaces of each partial layer with an electrically insulating material between each two deposition operations; and stripping said insulating material from the top surface of each partial layer prior to the next succeeding deposition operation.

5. The process according to claim 4 wherein said coating step is accomplished by filling the free spaces between areas of said deposited metal after each partial layer is deposited with an electrically insulating material.

6. A process for the production of screen printing blocks by electroplating of metal on a conductive surface wherein selected portions of said surface are coated with a photoresist which is exposed by means of a diapositive having black and transparent areas with a black line screen, and then developing and fixing on the uncovered zones corresponding to the black areas, said process comprising the steps of:

depositing a first partial layer of said metal on the areas of said conductive surface remaining uncovered by said photoresist after development and fixing thereof to a depth substantially less than the desired terminal thickness; then coating the exposed surfaces, including the top and sides, of said first partial layer of said metal with an electrically insulating material;

stripping said insulating material from the top surface of said first partial layer; and then depositing a second partial layer of said metal on said first partial layer.

7. A process for the production of screen printing blocks by electroplating of metal on a conductive surface wherein selected portions of said surface are coated with a photoresist which is exposed by means of a diapositive having black and transparent areas with a black line screen, and then developing and fixing on the uncovered zones corresponding to the black areas, said process comprising the steps of:

depositing said metal in at least two deposition operations on the areas of said conductive surface remaining uncovered by said photoresist after development and fixing thereof to thereby produce a terminal layer thickness built up of at least two partial layers of deposited metal;

coating the exposed top and side surfaces of each partial layer between each two deposition operations; and stripping said insulating material from the top surface of each partial layer prior to the next succeeding deposition operation.

8. A process for the production of screen material by means of electrodeposition of metal on a smooth surfaced matrix having conductive and non-conductive areas on said surface, said process comprising the steps of:

depositing a first partial layer of said metal on said conductive areas of said matrix to a depth substantially less than the desired screen material thickness; then coating the exposed side surfaces of said first partial layer of said metal with an electrically insulating material; and then depositing a second partial layer of said metal on said first partial layer.

* * * * *